US010619610B2

(12) United States Patent
Miyagi et al.

(10) Patent No.: US 10,619,610 B2
(45) Date of Patent: Apr. 14, 2020

(54) OUTBOARD MOTOR

(71) Applicant: YAMAHA HATSUDOKI KABUSHIKI KAISHA, Iwata-shi, Shizuoka (JP)

(72) Inventors: Yuta Miyagi, Shizuoka (JP); Yoshiyuki Kadobayashi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 17 days.

(21) Appl. No.: 16/186,752

(22) Filed: Nov. 12, 2018

(65) Prior Publication Data

US 2019/0242339 A1 Aug. 8, 2019

(30) Foreign Application Priority Data

Feb. 2, 2018 (JP) ..... 2018-017646

(51) Int. Cl.
*F02M 37/00* (2006.01)
*F02D 41/30* (2006.01)
(Continued)

(52) U.S. Cl.
CPC ..... *F02M 37/0029* (2013.01); *B63H 20/001* (2013.01); *F02B 61/045* (2013.01); *F02D 33/003* (2013.01); *F02D 41/3082* (2013.01); *F02M 37/0017* (2013.01); *F02M 37/0058* (2013.01); *F02M 37/0088* (2013.01); *F02M 37/20* (2013.01); *F02M 37/22* (2013.01); *F02D 2200/0602* (2013.01)

(58) Field of Classification Search
CPC ..... F02M 37/0029; F02M 37/20; F02M 37/0058; F02M 37/0017; F02M 37/22; F02M 37/0088; F02B 61/045; F02D 33/003; F02D 41/3082; F02D 2200/0602; B63H 20/001
USPC ..... 440/88 F
See application file for complete search history.

(56) References Cited

U.S. PATENT DOCUMENTS 5,669,358 A * 9/1997 Osakabe ..... F02B 61/045 123/196 W
5,724,936 A * 3/1998 Osakabe ..... F02B 61/045 123/195 A (Continued)

FOREIGN PATENT DOCUMENTS

JP 4587557 B2 11/2010

*Primary Examiner* — Anthony D Wiest
(74) *Attorney, Agent, or Firm* — Keating & Bennett, LLP

(57) ABSTRACT

An outboard motor includes a vapor separator tank, a downstream fuel supply path, a fuel pump that discharges a fuel in the vapor separator tank into the downstream fuel supply path, a downstream bypass path, and a downstream relief valve provided in the downstream bypass path. A first end of the downstream bypass path is connected to a downstream portion that is closer to the fuel injector than is the downstream check valve in the downstream fuel supply path, and a second end of the downstream bypass path is connected to an upstream portion between the downstream check valve and the vapor separator tank in the downstream fuel supply path. The downstream relief valve opens the downstream bypass path when a fuel pressure in a downstream region that is closer to the fuel injector than is the downstream check valve in the downstream fuel supply path exceeds a first predetermined value.

7 Claims, 2 Drawing Sheets

(51) Int. Cl.

| | |
|---|---|
| ***B63H 20/00*** | (2006.01) |
| ***F02M 37/22*** | (2019.01) |
| ***F02M 37/20*** | (2006.01) |
| ***F02B 61/04*** | (2006.01) |
| ***F02D 33/00*** | (2006.01) |

(56) References Cited

U.S. PATENT DOCUMENTS

| | | | | |
|---|---|---|---|---|
| 6,276,340 | B1 * | 8/2001 | Kato | F02B 61/045<br>123/179.16 |
| 6,698,401 | B2 * | 3/2004 | Suzuki | F02B 61/045<br>123/497 |
| 7,395,814 | B1 * | 7/2008 | Doepke | F02M 63/0225<br>123/497 |
| 2005/0000495 | A1 * | 1/2005 | Hamada | F02M 37/0058<br>123/516 |

* cited by examiner

OUTBOARD MOTOR

CROSS REFERENCE TO RELATED APPLICATIONS

This application claims the benefit of priority to Japanese Patent Application No. 2018-017646 filed on Feb. 2, 2018. The entire contents of this application are hereby incorporated herein by reference.

BACKGROUND OF THE INVENTION

1. Field of the Invention

The present invention relates to an outboard motor.

2. Description of the Related Art

An outboard motor described in Japanese Patent Publication No. 4587557 includes an internal combustion engine that rotates a propeller, and is supported by a hull. The internal combustion engine includes an internal combustion engine main body and a fuel supply device. The fuel supply device includes a fuel injection valve, a high pressure fuel pump, a first fuel passage, a vapor separator tank, a second fuel passage, and a low pressure fuel pump. The high pressure fuel pump is located inside the vapor separator tank. The first fuel passage connects the fuel injection valve and the high pressure fuel pump. The second fuel passage connects a fuel tank supported by the hull and the vapor separator tank. The low pressure fuel pump is provided in the middle of the second fuel passage. During operation of the outboard motor, a fuel from the fuel tank is pressurized by the low pressure fuel pump and supplied to the vapor separator tank, and further pressurized by the high pressure fuel pump and then injected into a cylinder of the internal combustion engine main body by the fuel injection valve to be combusted with air. Accordingly, the internal combustion engine main body generates a driving force.

In a conventional outboard motor such as the outboard motor described in Japanese Patent Publication No. 4587557, a fuel pressure inside a fuel supply path is commonly regulated by a pressure regulator. In this case, even when the fuel pressure inside the fuel supply path rises due to residual heat, etc., after operation of the outboard motor is stopped, the pressure regulator is activated to release the fuel inside the fuel supply path into the fuel tank, etc., so that the fuel pressure inside the fuel supply path is prevented from exceeding an upper limit.

The inventor of preferred embodiments of the present invention considered, in a fuel system of an outboard motor, an arrangement in which a fuel pressure sensor that detects a fuel pressure inside a fuel supply path is provided in place of the pressure regulator, and a fuel pump is feedback-controlled according to the detection results of the fuel pressure sensor. In the arrangement in which the fuel pump is feedback-controlled, a fuel injection pressure can be changed in response to a change in the operation status of the outboard motor, so that a dynamic range with respect to fuel injection can be expanded, and improvements in fuel economy, output, and emission performance by high-pressure injection can be realized. Further, in this arrangement, the fuel pump is controlled according to a fuel flow rate necessary in the internal combustion engine, so that an energy-saving operation of the fuel pump is enabled, and generation of evaporated gas due to excess fuel can be suppressed.

Such a case in which the fuel pump is feedback-controlled also requires an arrangement to prevent a fuel pressure inside a fuel supply path from exceeding an upper limit after operation of the outboard motor is stopped.

SUMMARY OF THE INVENTION

Preferred embodiments of the present invention provide outboard motors each including an internal combustion engine, an upstream fuel supply path, a vapor separator tank, a downstream fuel supply path, a fuel pump, a fuel pressure sensor, a controller, a fuel injector, a downstream check valve, a downstream bypass path, and a downstream relief valve. The upstream fuel supply path is connected to a fuel tank that stores a fuel of the internal combustion engine. The vapor separator tank separates a fuel vapor from a liquid fuel, and is connected to the upstream fuel supply path. The downstream fuel supply path is connected to the vapor separator tank. The fuel pump is provided inside the vapor separator tank, and discharges a fuel in the vapor separator tank into the downstream fuel supply path. The fuel pressure sensor detects a fuel pressure inside the downstream fuel supply path. The controller applies fuel pressure feedback control to the fuel pump according to detection results of the fuel pressure sensor. The fuel injector injects a fuel inside the downstream fuel supply path into the internal combustion engine. The downstream check valve is provided in the downstream fuel supply path, and allows a flow of fuel from the vapor separator tank to the fuel injector, and prohibits a flow of fuel from the fuel injector to the vapor separator tank. A first end of the downstream bypass path is connected to a downstream portion that is closer to the fuel injector than is the downstream check valve in the downstream fuel supply path, and a second end of the downstream bypass path is connected to an upstream portion between the downstream check valve and the vapor separator tank in the downstream fuel supply path. The downstream relief valve is provided in the downstream bypass path. The downstream relief valve opens the downstream bypass path when a fuel pressure in a downstream region that is closer to the fuel injector than is the downstream check valve in the downstream fuel supply path exceeds a first predetermined value.

With this structure, the fuel in the fuel tank flows through the upstream fuel supply path and is supplied to the vapor separator tank, then discharged into the downstream fuel supply path by the fuel pump, and injected into the internal combustion engine by the fuel injector. According to the results of detection of the fuel pressure inside the downstream fuel supply path by the fuel pressure sensor, the fuel pump is subjected to fuel pressure feedback control. Due to the downstream check valve being provided in the downstream fuel supply path, a reverse flow of fuel from the downstream fuel supply path to the vapor separator tank is prevented during operation of the outboard motor.

After operation of the outboard motor is stopped, when a fuel pressure in the downstream region that is closer to the fuel injector than is the downstream check valve in the downstream fuel supply path rises due to residual heat, etc., and exceeds the first predetermined value, the downstream relief valve opens the downstream bypass path. The first predetermined value is set to be lower than an assumed upper limit of the fuel pressure inside the downstream fuel supply path. By opening the downstream bypass path with the downstream relief valve, the fuel at a raised pressure in the downstream region passes through the downstream bypass path and the upstream portion and is released into the vapor separator tank. Therefore, the fuel pressure in the downstream fuel supply path is prevented from exceeding the upper limit after operation of the outboard motor is stopped.

In a preferred embodiment of the present invention, the fuel pressure sensor is located in the downstream region, and the downstream portion is positioned closer to the downstream check valve than is the fuel pressure sensor in the downstream region.

With this structure, as compared with a case in which the downstream portion is provided at a position that is closer to the fuel injector than is the fuel pressure sensor in the downstream region, the downstream bypass path to be connected to the downstream portion is able to be shortened. Accordingly, the fuel system of the outboard motor is compact. Therefore, the fuel pressure in the downstream fuel supply path is prevented by the compact structure from exceeding the upper limit after operation of the outboard motor is stopped.

In a preferred embodiment of the present invention, the fuel pump includes a first fuel pump including a check valve at a fuel discharge port connected to the downstream fuel supply path, and a second fuel pump not including a check valve at a fuel discharge port connected to the downstream fuel supply path.

With this structure, a large amount of fuel is able be supplied to the internal combustion engine by activation of both of the first fuel pump and the second fuel pump. When only the second fuel pump is activated, a fuel discharged from the fuel discharge port of the second fuel pump is prevented from flowing into the first fuel pump from the fuel discharge port of the first fuel pump by the check valve of the first fuel pump. Accordingly, the fuel discharged from the fuel discharge port of the second fuel pump is efficiently supplied to the internal combustion engine.

When a fuel pressure in the downstream region of the downstream fuel supply path exceeds the first predetermined value and the downstream relief valve opens the downstream bypass path, a fuel that has passed through the downstream bypass path from the downstream region is released from the fuel discharge port of the second fuel pump into the vapor separator tank. The fuel released into the vapor separator tank is released to the upstream fuel supply path that is located upstream of the vapor separator tank. Accordingly, the fuel pressure in the downstream fuel supply path is effectively prevented from exceeding the upper limit after operation of the outboard motor is stopped.

In a preferred embodiment of the present invention, the outboard motor further includes a pressurization pump that is located in the downstream region, and pressurizes and feeds a fuel in the downstream region into the fuel injector.

With this structure, the pressurization pump pressurizes a fuel in the downstream region, so that a fuel pressure in the downstream region after operation of the outboard motor is stopped is comparatively high, and easily rises due to residual heat, etc. Even with this structure, when the fuel pressure in the downstream region exceeds the first predetermined value, the downstream relief valve opens the downstream bypass path and the fuel in the downstream region is accordingly released into the vapor separator tank, so that the fuel pressure in the downstream fuel supply path is prevented from exceeding the upper limit.

In a preferred embodiment of the present invention, the downstream region includes a first fuel pipe connecting the downstream check valve and the pressurization pump, and a second fuel pipe connecting the pressurization pump and the fuel injector. The fuel pressure sensor includes a first fuel pressure sensor that detects a fuel pressure inside the first fuel pipe, and a second fuel pressure sensor that detects a fuel pressure inside the second fuel pipe. The controller applies fuel pressure feedback control to the fuel pump according to detection results of the first fuel pressure sensor, and applies fuel pressure feedback control to the pressurization pump according to detection results of the second fuel pressure sensor.

With this structure, in the downstream region, a fuel at a comparatively low pressure flows in the first fuel pipe, and a fuel at a comparatively high pressure flows in the second fuel pipe. With two-stage fuel pressure feedback control including fuel pressure feedback control for fuel inside each of the first fuel pipe and the second fuel pipe, the fuel in the downstream region is accurately raised in pressure to a target value and then supplied to the internal combustion engine.

In a preferred embodiment of the present invention, the first fuel pipe is elastically deformable, and the second fuel pipe is made of metal.

With this structure, due to elastic deformation of the first fuel pipe, a fuel pressure rise inside the first fuel pipe is able to be alleviated. Accordingly, the fuel pressure in the downstream fuel supply path is effectively prevented from exceeding the upper limit after operation of the outboard motor is stopped. The second fuel pipe in which a fuel at a comparatively high pressure flows is made of metal, so that pressure resistance is achieved.

In a preferred embodiment of the present invention, the outboard motor further includes an upstream check valve, an upstream bypass path, and an upstream relief valve. The upstream check valve is provided in the upstream fuel supply path, and allows a flow of fuel to the vapor separator tank, and prohibits a reverse flow of fuel from the vapor separator tank. A first end of the upstream bypass path is connected to a downstream portion that is closer to the vapor separator tank than is the upstream check valve, and a second end of the upstream bypass path is connected to an upstream portion that is farther away from the vapor separator tank than is the upstream check valve, in the upstream fuel supply path. The upstream relief valve is provided in the upstream bypass path. When a fuel pressure in an intermediate region between the upstream check valve and the vapor separator tank in the upstream fuel supply path exceeds a second predetermined value, the upstream relief valve opens the upstream bypass path.

With this structure, due to the upstream check valve being provided in the upstream fuel supply path, a reverse flow of fuel from the vapor separator tank is prevented during operation of the outboard motor. After operation of the outboard motor is stopped, when a fuel in the downstream fuel supply path flows into the vapor separator tank through the downstream bypass path, and then reaches the intermediate region between the upstream check valve and the vapor separator tank in the upstream fuel supply path, a fuel pressure in the intermediate region rises. When the fuel pressure in the intermediate region exceeds the second predetermined value, the upstream relief valve opens the upstream bypass path. The second predetermined value is set to be lower than an assumed upper limit of the fuel pressure in the intermediate region. By opening the upstream bypass path by the upstream relief valve, the fuel at a raised pressure in the intermediate region is released further upstream through the upstream bypass path and the upstream portion. Therefore, the fuel pressure in the downstream fuel supply path is effectively prevented from exceeding the upper limit after operation of the outboard motor is stopped.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
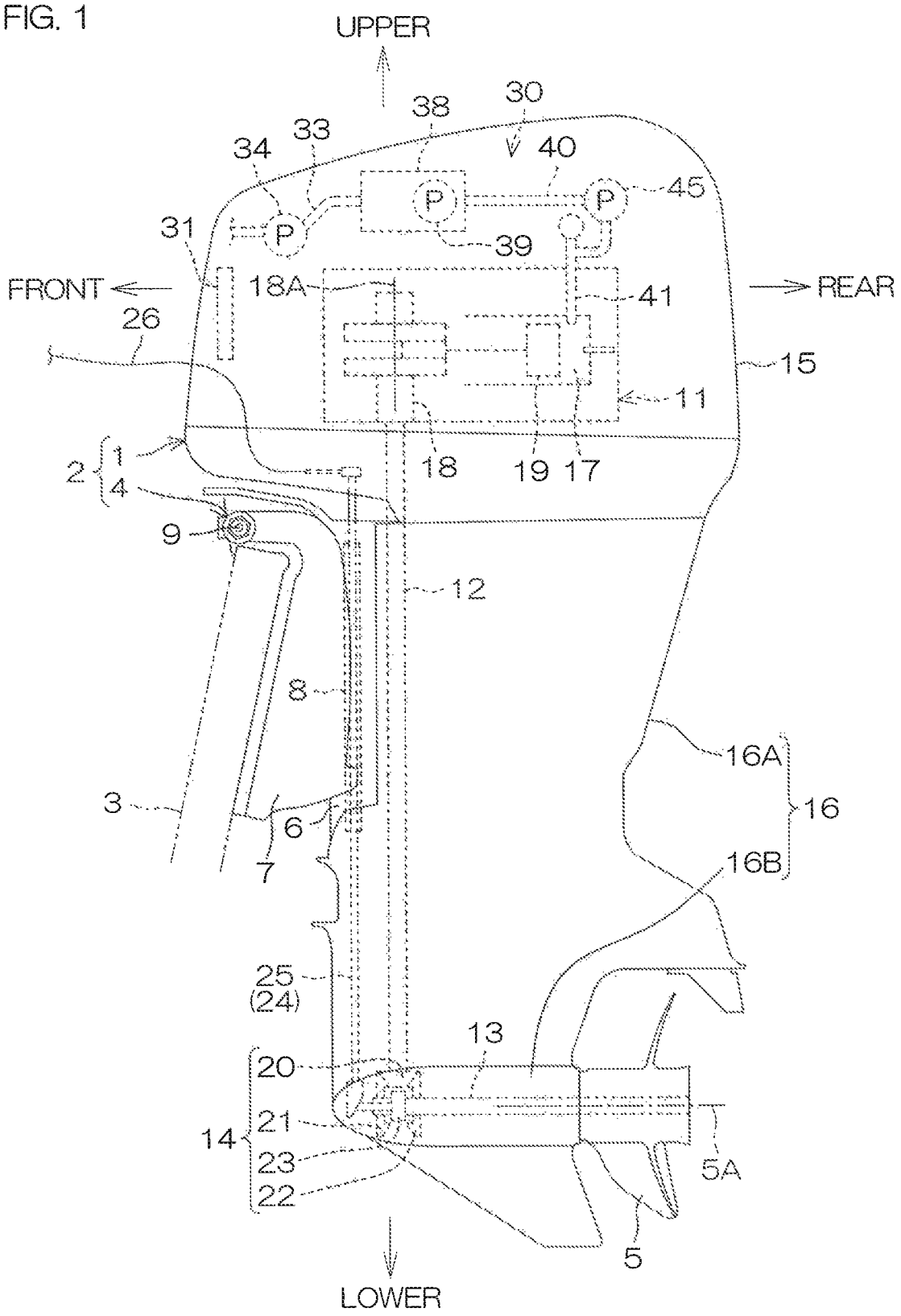
FIG. 1 is a schematic left side view of a vessel propulsion apparatus including an outboard motor according to a preferred embodiment of the present invention.

Hereinafter, preferred embodiments of the present invention are described in detail with reference to the accompanying drawings. FIG. 1 is a schematic left side view of a vessel propulsion apparatus 2 including an outboard motor 1 according to a preferred embodiment of the present invention. The vessel propulsion apparatus 2 includes the outboard motor 1 that generates a propulsive force to propel a vessel, and a mounting mechanism 4 to mount the outboard motor 1 on a hull 3. The left side in FIG. 1 is the front side of the outboard motor 1, and the right side in FIG. 1 is the rear side of the outboard motor 1. The front side in a direction orthogonal to the sheet surface of FIG. 1 is the left side of the outboard motor 1, and the back side in the direction orthogonal to the sheet surface of FIG. 1 is the right side of the outboard motor 1. FIG. 1 shows the outboard motor 1 present at a tilt-down position. The tilt-down position is a position of the outboard motor 1 in a substantially vertical posture when a rotation axis 5A of a propeller 5 in the outboard motor 1 extends along both the horizontal direction and the front-rear direction. Hereinafter, the outboard motor 1 at the tilt-down position is described unless otherwise noted.

The mounting mechanism 4 includes a swivel bracket 6, a clamp bracket 7, a steering shaft 8, and a tilting shaft 9. The steering shaft 8 extends in an up-down direction. The tilting shaft 9 extends in a left-right direction along the horizontal direction. The swivel bracket 6 is joined to the outboard motor 1 via the steering shaft 8. The clamp bracket 7 is joined to the swivel bracket 6 via the tilting shaft 9. The clamp bracket 7 is fixed to a rear portion of the hull 3. Accordingly, the outboard motor 1 is mounted on the rear portion of the hull 3 by the mounting mechanism 4.

The outboard motor 1 and the swivel bracket 6 are turnable up and down around the tilting shaft 9 with respect to the clamp bracket 7. Due to the outboard motor 1 being turned around the tilting shaft 9, the outboard motor 1 is tilted with respect to the hull 3 and the clamp bracket 7. The outboard motor 1 is turnable to the left and right together with the steering shaft 8 with respect to the swivel bracket 6 and the clamp bracket 7.

The outboard motor 1 includes an internal combustion engine 11, a driveshaft 12, a propeller shaft 13, a gear mechanism 14, an engine cover 15, and a casing 16. The internal combustion engine 11 includes a combustion chamber 17, a crankshaft 18, and a piston 19. The crankshaft 18 has a crank axis 18A extending in the up-down direction. Due to combustion of an air-fuel mixture inside the combustion chamber 17, the piston 19 linearly reciprocates in the front-rear direction orthogonal to the crank axis 18A. Accordingly, the crankshaft 18 is rotated around the crank axis 18A.

The driveshaft 12 extends downward from the internal combustion engine 11. The driveshaft 12 is integrally rotatable with the crankshaft 18, and is rotated by the internal combustion engine 11.

The propeller shaft 13 extends in the front-rear direction at a lower side than a lower end portion of the driveshaft 12. The propeller 5 is attached to a rear end portion of the propeller shaft 13. The gear mechanism 14 is joined to a lower end portion of the driveshaft 12 and a front end portion of the propeller shaft 13. To the propeller shaft 13, rotation of the driveshaft 12 is transmitted via the gear mechanism 14. The gear mechanism 14 includes a drive gear 20, a first transmission gear 21, a second transmission gear 22, and a clutch body 23. The outboard motor 1 further includes a shift mechanism 24 that moves the clutch body 23.

The drive gear 20, the first transmission gear 21, and the second transmission gear 22 are, for example, cylindrical bevel gears. The drive gear 20 is attached to a lower end portion of the driveshaft 12. The first transmission gear 21 surrounds a portion in front of the drive gear 20 at a front end portion of the propeller shaft 13. The second transmission gear 22 surrounds a portion in the rear of the drive gear 20 at a front end portion of the propeller shaft 13. The first transmission gear 21 and the second transmission gear 22 are located so as to face each other at an interval in the front-rear direction, and engage with the drive gear 20. When the drive gear 20 rotates integrally with the driveshaft 12 along with driving of the internal combustion engine 11, the rotation of the drive gear 20 is transmitted to the first transmission gear 21 and the second transmission gear 22. Accordingly, the first transmission gear 21 and the second transmission gear 22 rotate in directions opposite to each other around the propeller shaft 13.

The clutch body 23 is located between the first transmission gear 21 and the second transmission gear 22. The clutch body 23 is, for example, a cylindrical dog clutch, and surrounds a front end portion of the propeller shaft 13. The clutch body 23 is joined to the front end portion of the propeller shaft 13 by, for example, a spline. Therefore, the clutch body 23 rotates together with the front end portion of the propeller shaft 13. Further, the clutch body 23 is movable in the front-rear direction with respect to the front end portion of the propeller shaft 13.

The shift mechanism 24 includes a shift rod 25 extending in the up-down direction. The shift rod 25 is coupled to an operation cable 26 connected to an operation lever (not shown) to be operated by a vessel operator. Due to an operation force input from the operation cable 26, the shift rod 25 is turned around an axis of the shift rod 25. Due to turning of the shift rod 25, the clutch body 23 moves in the front-rear direction, and is located at any of a neutral position, a forward position, and a reverse position.

The neutral position is a position at which the clutch body 23 engages with neither of the first transmission gear 21 and the second transmission gear 22, and is between the forward position and the reverse position. In a state where the clutch body 23 is located at the neutral position, rotation of the driveshaft 12 is not transmitted to the propeller shaft 13, so that a shift position of the outboard motor 1 is at "neutral."

The forward position is a position at which the clutch body 23 engages with an inner circumferential portion of the first transmission gear 21, and the reverse position is a position at which the clutch body 23 engages with an inner circumferential portion of the second transmission gear 22. In a state where the clutch body 23 is located at the forward position and joined to the first transmission gear 21, rotation of the first transmission gear 21 is transmitted to the propeller shaft 13, so that the shift position of the outboard motor 1 is at "forward." When rotation of the first transmission gear 21 is transmitted to the propeller shaft 13, the propeller 5 rotates in a forward rotation direction. Accordingly, a propulsive force in a forward traveling direction is generated. In a state where the clutch body 23 is located at the reverse position and joined to the second transmission gear 22, rotation of the second transmission gear 22 is transmitted to the propeller shaft 13, so that the shift position of the outboard motor 1 is at "reverse." When rotation of the second transmission gear 22 is transmitted to the propeller shaft 13, the propeller 5 rotates in a reverse rotation direction opposite to the forward rotation direction. Accordingly, a propulsive force in a reverse traveling direction is generated.

The engine cover 15 is preferably box shaped or substantially box shaped, and houses the internal combustion engine 11, and at least an upper end portion of the driveshaft 12. The casing 16 is a hollow body extending downward from the engine cover 15. The casing 16 includes an exhaust guide (not shown) equipped with the internal combustion engine 11, an upper case 16A located below the exhaust guide, and a lower case 16B located below the upper case 16A.

The driveshaft 12 penetrates through the exhaust guide. The upper case 16A houses a middle portion of the driveshaft 12. The lower case 16B houses at least a lower end portion of the driveshaft 12, the propeller shaft 13, the gear mechanism 14, and at least a lower end portion of the shift rod 25. The propeller 5 attached to the rear end portion of the propeller shaft 13 protrudes rearward from the lower case 16B.

The outboard motor 1 includes a fuel system 30 to supply a fuel to the internal combustion engine 11, and an ECU (Engine Controller) 31 as an example of the controller. The fuel system 30 and the ECU 31 are located inside the engine cover 15.

Figure 2:
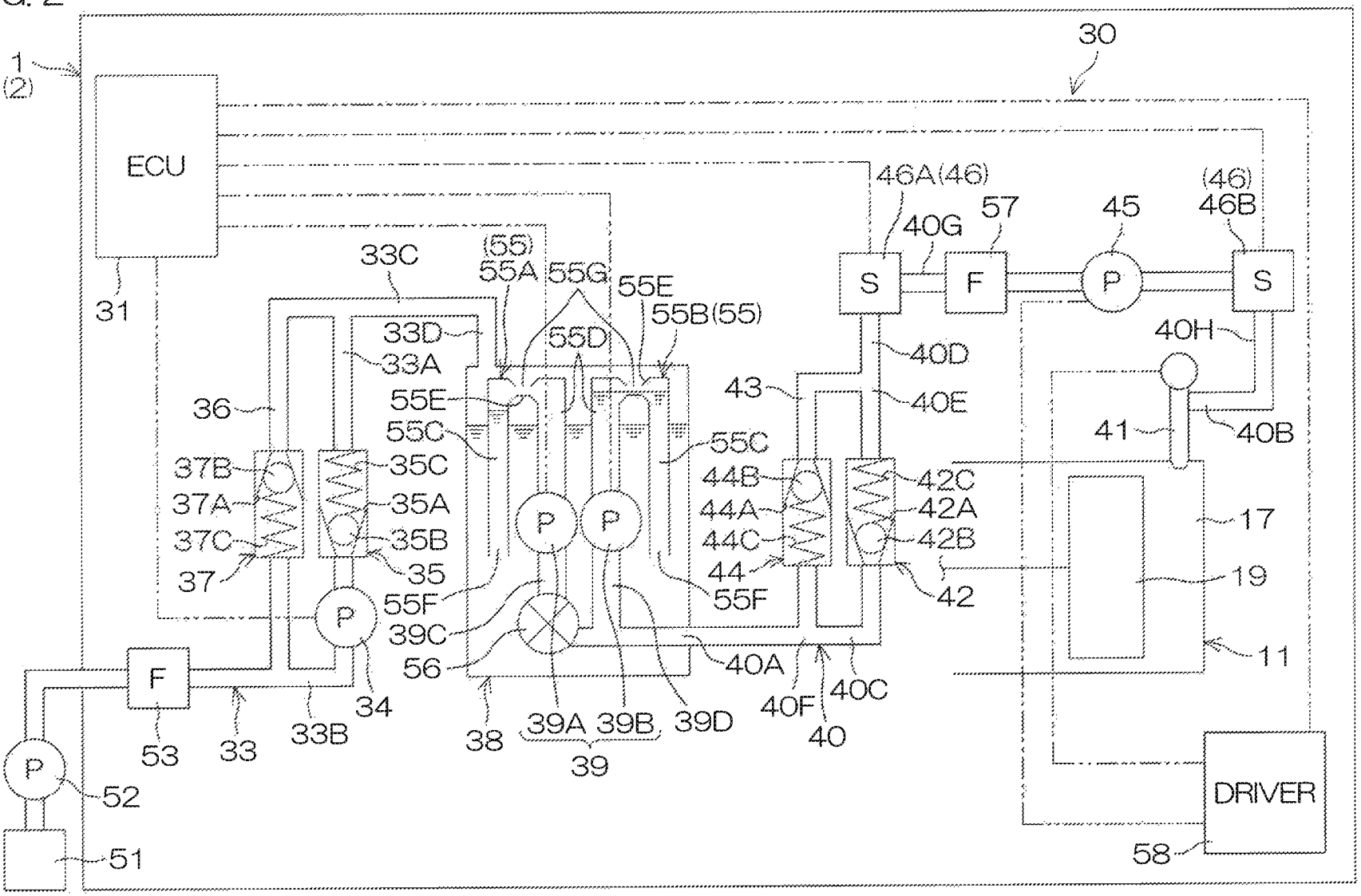
FIG. 2 is a diagram to describe a fuel system of an outboard motor according to a preferred embodiment of the present invention.

FIG. 2 is a diagram to describe the fuel system 30 and the ECU 31. The fuel system 30 includes an upstream fuel supply path 33, a pumping-out pump 34, an upstream check valve 35, an upstream bypass path 36, and an upstream relief valve 37. The fuel system 30 further includes a vapor separator tank 38, a fuel pump 39, a downstream fuel supply path 40, a fuel injector 41, a downstream check valve 42, a downstream bypass path 43, a downstream relief valve 44, a pressurization pump 45, and a fuel pressure sensor 46.

The upstream fuel supply path 33 is connected to a fuel tank 51 provided in the hull 3 and the vapor separator tank 38, and connects the fuel tank 51 and the vapor separator tank 38. In the fuel tank 51, a fuel of the internal combustion engine 11 is stored. The upstream fuel supply path 33 is positioned downstream of the fuel tank 51 and upstream of the vapor separator tank 38 in a flowing direction of fuel from the fuel tank 51 to the internal combustion engine 11 in the fuel system 30. At a portion outside of the outboard motor 1 in the upstream fuel supply path 33, a primary pump 52 to be used by an operator to manually pump out the fuel inside the fuel tank 51 into the upstream fuel supply path 33 may be provided. At a portion positioned inside the outboard motor 1 in the upstream fuel supply path 33, an upstream filter 53 that separates moisture and traps foreign matter from a fuel flowing in the upstream fuel supply path 33 is provided.

The pumping-out pump 34 is provided in a region between the upstream filter 53 and the vapor separator tank 38 in the upstream fuel supply path 33. The pumping-out pump 34 includes, for example, an electromagnetic pump. When the pumping-out pump 34 is turned ON, it is activated and pumps out a fuel inside the fuel tank 51 into the upstream fuel supply path 33 and supplies the fuel to the vapor separator tank 38.

The upstream check valve 35 is provided in a region between the pumping-out pump 34 and the vapor separator tank 38 in the upstream fuel supply path 33. The upstream check valve 35 includes a valve seat 35A, a valve element 35B, and a biasing member 35C. An example of the valve seat 35A is a tapered surface spreading toward the downstream side. A space surrounded by this tapered surface defines a portion of the upstream fuel supply path 33. An example of the valve element 35B is a spherical body. An example of the biasing member 35C is a coil spring that biases the valve element 35B from the downstream side so as to cause the valve element 35B to come into contact with the valve seat 35A. When a fuel pumped out by the pumping-out pump 34 comes into contact with the valve element 35B from the upstream side at a pressure (hereinafter, referred to as "fuel pressure") not less than a predetermined value, the valve element 35B moves downstream against a biasing force of the biasing member 35C. Accordingly, a gap is formed between the valve seat 35A and the valve element 35B. The fuel passes through this gap and flows to the vapor separator tank 38 that is downstream of the upstream check valve 35. On the other hand, when the fuel pressure in the region that is upstream of the valve element 35B in the upstream fuel supply path 33 is less than the predetermined value, no gap is formed between the valve seat 35A and the valve element 35B, so that the fuel downstream of the upstream check valve 35 cannot flow upstream beyond the upstream check valve 35. That is, the upstream check valve 35 allows a flow of fuel to the vapor separator tank 38, and prohibits a reverse flow of fuel from the vapor separator tank 38.

A first end of the upstream bypass path 36 is connected to a downstream portion 33A that is closer to the vapor separator tank 38 than is the upstream check valve 35 in the upstream fuel supply path 33, and a second end of the upstream bypass path is connected to an upstream portion 33B that is farther away from the vapor separator tank 38 than is the upstream check valve 35 in the upstream fuel supply path 33.

The upstream relief valve 37 is provided in the upstream bypass path 36. The upstream relief valve 37 includes a valve seat 37A, a valve element 37B, and a biasing member 37C. An example of the valve seat 37A is a tapered surface spreading toward the upstream side. A space surrounded by this tapered surface defines a portion of the upstream bypass path 36. An example of the valve element 37B is a spherical body. An example of the biasing member 37C is a coil spring that biases the valve element 37B from the upstream side so as to cause the valve element 37B to come into contact with the valve seat 37A. Even when a fuel in a region upstream of the pumping-out pump 34 in the upstream fuel supply path 33 flows into the upstream bypass path 36, no gap is formed between the valve seat 37A and the valve element 37B. Therefore, this fuel cannot flow downstream beyond the upstream relief valve 37 in the upstream bypass path 36. Therefore, at the time of operation of the outboard motor 1, this fuel returns from the upstream bypass path 36 to the upstream fuel supply path 33 and flows to the vapor separator tank 38. On the other hand, when a fuel pressure in an intermediate region 33C between the upstream check valve 35 and the vapor separator tank 38 in the upstream fuel supply path 33 exceeds a predetermined value (hereinafter, referred to as a "second predetermined value"), the valve element 37B moves upstream against a biasing force of the biasing member 37C. Accordingly, a gap is formed between the valve seat 37A and the valve element 37B, and the upstream bypass path 36 is opened.

The vapor separator tank 38 stores a fuel pumped out from the fuel tank 51, and separates a fuel vapor from a liquid fuel. The vapor stays at an upper portion of an internal space of the vapor separator tank 38. A downstream end portion 33D of the upstream fuel supply path 33 is connected to the upper portion (for example, a ceiling wall) of the vapor separator tank 38.

The vapor separator tank 38 includes a plurality of inversion flow paths 55. The vapor separator tank 38 in the present preferred embodiment includes a first inversion flow path 55A and a second inversion flow path 55B, for example. These are collectively called "inversion flow paths 55." Each inversion flow path 55 includes an inlet flow path 55C and an outlet flow path 55D extending up and down, and a middle flow path 55E connecting upper ends of the inlet flow path 55C and the outlet flow path 55D to each other, and preferably have an upside-down U shape. At a lower end of the inlet flow path 55C, an inlet 55F is provided. The inlet 55F is located at a position lower than a liquid level of the fuel inside the vapor separator tank 38. The fuel inside the vapor separator tank 38 flows into the inlet flow path 55C from the inlet 55F. The liquid level of the fuel inside the inversion flow path 55 may not be at the same height as a liquid level of a fuel that exists outside the inversion flow path 55 inside the vapor separator tank 38. The middle flow path 55E preferably includes a Venturi tube, and at a portion with the smallest flow path sectional area in the middle flow path 55E, an opening 55G facing upward is provided. The opening 55G is located at a position higher than the liquid level of the fuel inside the vapor separator tank 38.

The fuel pump 39 is preferably a so-called low pressure fuel pump, and is provided inside the vapor separator tank 38. The fuel pump 39 includes a first fuel pump 39A provided at a lower end of the outlet flow path 55D of the first inversion flow path 55A, and a second fuel pump 39B provided at a lower end of the outlet flow path 55D of the second inversion flow path 55B. At the time of supplying fuel to the internal combustion engine 11, the second fuel pump 39B defines and functions as a main pump, and the first fuel pump 39A defines and functions as a sub-pump. The fuel pump 39 is operated intermittently. The first fuel pump 39A includes a fuel discharge port 39C, and sucks in a fuel inside the first inversion flow path 55A and discharges the fuel from the fuel discharge port 39C. The second fuel pump 39B includes a fuel discharge port 39D, and sucks in a fuel inside the second inversion flow path 55B and discharges the fuel from the fuel discharge port 39D. At the fuel discharge port 39C, a check valve 56 is provided to prevent the discharged fuel from flowing reversely to the fuel discharge port 39C, however, no similar check valve is provided at the fuel discharge port 39D. The first fuel pump 39A includes a relief valve (not shown) that is activated so as to release a fuel inside the fuel discharge port 39C to the upstream outlet flow path 55D when a fuel pressure at the fuel discharge port 39C exceeds a predetermined value. The second fuel pump 39B also includes a similar relief valve. When the fuel pump 39 is activated and a fuel inside the inversion flow path 55 flows, vapor at a position higher than a liquid level of the fuel inside the vapor separator tank 38 is taken into the fuel inside the inversion flow path 55 from an opening 55G of the middle flow path 55E of the inversion flow path 55. This vapor is liquefied by being pressurized by the fuel pump 39, and discharged together with other liquid fuel from the fuel discharge port 39C or the fuel discharge port 39D.

The downstream fuel supply path 40 includes an upstream end portion 40A connected to the vapor separator tank 38. The upstream end portion 40A is located inside the vapor separator tank 38, and connected to the fuel discharge port 39C of the first fuel pump 39A and the fuel discharge port 39D of the second fuel pump 39B. The first fuel pump 39A and the second fuel pump 39B are connected to the downstream fuel supply path 40 in a mutually parallel relationship. A downstream end portion 40B of the downstream fuel supply path 40 is connected to the fuel injector 41. Therefore, the downstream fuel supply path 40 connects the vapor separator tank 38 and the fuel injector 41. The downstream fuel supply path 40 is positioned downstream of the vapor separator tank 38 and upstream of the fuel injector 41 in a flowing direction of fuel from the fuel tank 51 to the internal combustion engine 11 in the fuel system 30. A fuel discharged from the vapor separator tank 38 into the downstream fuel supply path 40 by the fuel pump 39 passes through the downstream fuel supply path 40 and flows to the fuel injector 41. The fuel injector 41 directly injects the fuel inside the downstream fuel supply path 40 into the combustion chamber 17 of the internal combustion engine 11. The fuel injected into the combustion chamber 17 mixes with air taken into the combustion chamber 17 from an intake tube (not shown) of the internal combustion engine 11 to produce the above-described air-fuel mixture.

The downstream check valve 42 is provided in the downstream fuel supply path 40. The downstream check valve 42 includes a valve seat 42A, a valve element 42B, and a biasing member 42C. An example of the valve seat 42A is a tapered surface spreading downstream. A space surrounded by this tapered surface defines a portion of the downstream fuel supply path 40. An example of the valve element 42B is a spherical body. An example of the biasing member 42C is a coil spring that biases the valve element 42B from the downstream side so as to cause the valve element 42B to come into contact with the valve seat 42A. An upstream region 40C positioned upstream of the downstream check valve 42 in the downstream fuel supply path 40 includes an upstream end portion 40A of the downstream fuel supply path 40. When a fuel from the vapor separator tank 38 is discharged to the upstream region 40C by the fuel pump 39, a fuel pressure in the upstream region 40C rises. When this fuel pressure reaches a predetermined value or more, the valve element 42B moves downstream against a biasing force of the biasing member 42C. Accordingly, a gap is formed between the valve seat 42A and the valve element 42B. The fuel passes through this gap and flows to a downstream region 40D that is closer to the fuel injector 41 than is the downstream check valve 42 in the downstream fuel supply path 40. On the other hand, when the fuel pressure in the upstream region 40C is less than the predetermined value, no gap is formed between the valve seat 42A and the valve element 42B, so that the fuel in the downstream region 40D cannot flow upstream beyond the downstream check valve 42. That is, the downstream check valve 42 allows a flow of fuel from the vapor separator tank 38 to the fuel injector 41, and prohibits a reverse flow of fuel from the fuel injector 41 to the vapor separator tank 38. Due to intermittent operation of the fuel pump 39, when the fuel pump 39 temporarily stops, a reverse flow of fuel may be generated, however, this reverse flow is prevented by the downstream check valve 42 from reaching the vapor separator tank 38.

A first end of the downstream bypass path 43 is connected to a downstream portion 40E that is closer to the fuel injector 41 than is the downstream check valve 42 in the downstream fuel supply path 40, and a second end of the downstream bypass path 43 is connected to an upstream portion 40F between the downstream check valve 42 and the vapor separator tank 38 in the downstream fuel supply path 40. The downstream portion 40E and the above-described downstream end portion 40B are portions of the downstream region 40D, and the upstream portion 40F is a portion of the upstream region 40C.

The downstream relief valve 44 is provided in the downstream bypass path 43. The downstream relief valve 44 includes a valve seat 44A, a valve element 44B, and a biasing member 44C. An example of the valve seat 44A is a tapered surface spreading upstream. A space surrounded by this tapered surface defines a portion of the downstream bypass path 43. An example of the valve element 44B is a spherical body. An example of the biasing member 44C is a coil spring that biases the valve element 44B from the upstream side so as to cause the valve element 44B to come into contact with the valve seat 44A. Even when a fuel in the upstream region 40C of the downstream fuel supply path 40 flows into the downstream bypass path 43, no gap is formed between the valve seat 44A and the valve element 44B. Therefore, this fuel cannot flow downstream beyond the downstream relief valve 44 in the downstream bypass path 43. Therefore, at the time of operation of the outboard motor 1, this fuel returns from the downstream bypass path 43 to the downstream fuel supply path 40 and flows to the fuel injector 41. On the other hand, when a fuel pressure in the downstream region 40D of the downstream fuel supply path 40 exceeds a predetermined value (hereinafter, referred to as a "first predetermined value"), the valve element 44B moves upstream against a biasing force of the biasing member 44C. Accordingly, a gap is formed between the valve seat 44A and the valve element 44B, and the downstream bypass path 43 is opened.

The pressurization pump 45 is preferably a so-called high pressure fuel pump, and is located in the downstream region 40D of the downstream fuel supply path 40. The pressurization pump 45 pressurizes and feeds the fuel in the downstream region 40D into the fuel injector 41. The downstream region 40D includes a first fuel pipe 40G connecting the downstream check valve 42 and the pressurization pump 45, and a second fuel pipe 40H connecting the pressurization pump 45 and the fuel injector 41. The first fuel pipe 40G is elastically deformable, and is made of, for example, rubber. The second fuel pipe 40H is made of, for example, a metal such as stainless steel.

The fuel pressure sensor 46 detects a fuel pressure inside the downstream fuel supply path 40, and is located in the downstream region 40D of the downstream fuel supply path 40. The fuel pressure sensor 46 includes a first fuel pressure sensor 46A that is located in the first fuel pipe 40G and detects a fuel pressure inside the first fuel pipe 40G, and a second fuel pressure sensor 46B that is located in the second fuel pipe 40H and detects a fuel pressure inside the second fuel pipe 40H. The first fuel pressure sensor 46A is located at an upstream position that is closer to the downstream check valve 42 than is the second fuel pressure sensor 46B in the downstream region 40D. The downstream portion 40E, to which the downstream bypass path 43 is connected in the downstream fuel supply path 40, is located at an upstream position that is closer to the downstream check valve 42 than is the first fuel pressure sensor 46A in the downstream region 40D. In a region between the first fuel pressure sensor 46A and the pressurization pump 45 in the first fuel pipe 40G, a downstream filter 57 that traps foreign matter from a fuel flowing in this region is provided.

The ECU 31 is electrically connected to the pumping-out pump 34, the fuel pump 39, the first fuel pressure sensor 46A, and the second fuel pressure sensor 46B. The ECU 31 is electrically connected to the fuel injector 41 and the pressurization pump 45 via a dedicated driver 58 that controls driving of the fuel injector 41 and the pressurization pump 45. The ECU 31 controls turning ON/OFF of the pumping-out pump 34. The ECU 31 applies fuel pressure feedback control to the fuel pump 39 according to the detection results of the first fuel pressure sensor 46A. More specifically, the ECU 31 performs feedback operation based on the detection results of the first fuel pressure sensor 46A, and operates the fuel pump 39 intermittently by, for example, PWM (Pulse Width Modulation) control so that a fuel pressure inside the first fuel pipe 40G approaches a target value. The ECU 31 applies fuel pressure feedback control to the pressurization pump 45 according to the detection results of the second fuel pressure sensor 46B. More specifically, the ECU 31 performs feedback operation based on the detection results of the second fuel pressure sensor 46B, and transmits drive signals based on the operation results to the driver 58. Among the received drive signals, based on an injector signal, the driver 58 drives the fuel injector 41, and based on a pump signal, the driver 58 drives the pressurization pump 45 so that a fuel pressure inside the second fuel pipe 40H approaches a target value.

As described above, with the structure of the present preferred embodiment, a fuel in the fuel tank 51 flows through the upstream fuel supply path 33 and is supplied to the vapor separator tank 38, then discharged into the downstream fuel supply path 40 by the fuel pump 39, and injected into the combustion chamber 17 of the internal combustion engine 11 by the fuel injector 41. According to the results of detection of the fuel pressure inside the downstream fuel supply path 40 by the fuel pressure sensor 46, the fuel pump 39 is subjected to fuel pressure feedback control. Due to the downstream check valve 42 being provided in the downstream fuel supply path 40, a reverse flow of fuel from the downstream fuel supply path 40 to the vapor separator tank 38 is prevented during operation of the outboard motor 1.

After operation of the outboard motor 1 is stopped, when the fuel pressure in the downstream region 40D that is closer to the fuel injector 41 than is the downstream check valve 42 in the downstream fuel supply path 40 rises due to residual heat, etc., and exceeds the first predetermined value described above, the downstream relief valve 44 opens the downstream bypass path 43. The first predetermined value is set to be lower than an assumed upper limit of the fuel pressure inside the downstream fuel supply path 40. By opening the downstream bypass path 43 with the downstream relief valve 44, the fuel at a raised pressure in the downstream region 40D passes through the downstream bypass path 43 and the upstream portion 40F and is released into the vapor separator tank 38. Therefore, the fuel pressure in the downstream fuel supply path 40 is prevented from exceeding the upper limit after operation of the outboard motor 1 is stopped.

In the present preferred embodiment, the fuel pressure sensor 46 is located in the downstream region 40D, and the downstream portion 40E is located at an upstream position that is closer to the downstream check valve 42 than is the fuel pressure sensor 46 in the downstream region 40D. Therefore, as compared with a case where the downstream portion 40E is provided at a downstream position that is closer to the fuel injector 41 than is the fuel pressure sensor 46 in the downstream region 40D, the downstream bypass path 43 to be connected to the downstream portion 40E is shortened. In addition, by locating the downstream check valve 42 not in the vapor separator tank 38 but in the downstream fuel supply path 40, the structure of the vapor separator tank 38 becomes simple.

Accordingly, the fuel system 30 of the outboard motor 1 is compact. Therefore, the fuel pressure in the downstream fuel supply path 40 is prevented by the compact structure from exceeding the upper limit after operation of the outboard motor 1 is stopped. With this structure, the downstream portion 40E and the upstream portion 40F of the downstream fuel supply path 40, the downstream check valve 42, the downstream bypass path 43, and the downstream relief valve 44 are able to be modular.

In the present preferred embodiment, at the time of rapid acceleration, etc., of a vessel, by activation of both of the first fuel pump 39A and the second fuel pump 39B, a large amount of fuel is able to be supplied to the internal combustion engine 11. When only the second fuel pump 39B is activated, a fuel discharged from the fuel discharge port 39D of the second fuel pump 39B is prevented from flowing into the first fuel pump 39A from the fuel discharge port 39C of the first fuel pump 39A by the check valve 56 of the first fuel pump 39A. Accordingly, the fuel discharged from the fuel discharge port 39D of the second fuel pump 39B is efficiently supplied to the internal combustion engine 11.

When a fuel pressure in the downstream region 40D exceeds the first predetermined value and the downstream relief valve 44 opens the downstream bypass path 43, a fuel that has flowed from the downstream region 40D to the downstream bypass path 43 is released from the fuel discharge port 39D of the second fuel pump 39B into the vapor separator tank 38. Additionally, the second fuel pump 39B at this time is in a state where the incorporated relief valve (not shown) is activated. The fuel released into the vapor separator tank 38 is released to the upstream fuel supply path 33 that is upstream of the vapor separator tank 38. Accordingly, the fuel pressure in the downstream fuel supply path 40 is alleviated, so that the fuel pressure in the downstream fuel supply path 40 is effectively prevented from exceeding the upper limit after operation of the outboard motor 1 is stopped.

In the present preferred embodiment, the pressurization pump 45 pressurizes the fuel in the downstream region 40D, so that a fuel pressure in the downstream region 40D after operation of the outboard motor 1 is stopped is comparatively high, and easily rises due to residual heat, etc. Even with this structure, when the fuel pressure in the downstream region 40D exceeds the first predetermined value, the downstream relief valve 44 opens the downstream bypass path 43 and the fuel in the downstream region 40D is accordingly released into the vapor separator tank 38. Therefore, the fuel pressure in the downstream fuel supply path 40 is prevented from exceeding the upper limit.

In the present preferred embodiment, in the downstream region 40D, a fuel at a comparatively low pressure of approximately several hundred kPa, for example, flows in the first fuel pipe 40G, and a fuel at a comparatively high pressure of, for example, approximately several MPa flows in the second fuel pipe 40H. By using two-stage fuel pressure feedback control including fuel pressure feedback control for each fuel inside the first fuel pipe 40G and the second fuel pipe 40H, the fuel in the downstream region 40D is accurately raised in pressure to a target value and then supplied to the internal combustion engine 11.

In the present preferred embodiment, due to elastic deformation of the first fuel pipe 40G, a fuel pressure rise inside the first fuel pipe 40G is able to be alleviated. Accordingly, the fuel pressure in the downstream fuel supply path 40 is more effectively prevented from exceeding the upper limit after operation of the outboard motor 1 is stopped. The second fuel pipe 40H in which a fuel at a comparatively high pressure flows is preferably made of metal, so that pressure resistance is achieved. When a fuel pressure in the second fuel pipe 40H rises to a predetermined value, a relief valve (not shown) incorporated in the pressurization pump 45 is activated, and accordingly, the fuel in the second fuel pipe 40H is released to the first fuel pipe 40G.

In the present preferred embodiment, due to the upstream check valve 35 being provided in the upstream fuel supply path 33, a reverse flow of fuel from the vapor separator tank 38 is prevented during operation of the outboard motor 1. It is assumed that, after operation of the outboard motor 1 is stopped, a fuel in the downstream fuel supply path 40 passes through the downstream bypass path 43 and flows into the vapor separator tank 38, and reaches the intermediate region 33C between the upstream check valve 35 and the vapor separator tank 38 in the upstream fuel supply path 33. In this case, a fuel pressure in the intermediate region 33C rises. When the fuel pressure in the intermediate region 33C exceeds the above-described second predetermined value, the upstream relief valve 37 opens the upstream bypass path 36. The second predetermined value is set to be lower than an assumed upper limit of the fuel pressure in the intermediate region 33C. By opening the upstream bypass path 36 with the upstream relief valve 37, the fuel at a raised pressure in the intermediate region 33C is released further upstream through the upstream bypass path 36 and the upstream portion 33B. Therefore, the fuel pressure in the downstream fuel supply path 40 is effectively prevented from exceeding the upper limit after operation of the outboard motor 1 is stopped. In the state where the upstream relief valve 37 opens the upstream bypass path 36, the fuel may be circulated between the upstream bypass path 36 and the upstream fuel supply path 33 so that the fuel pressure is alleviated.

Although preferred embodiments of the present invention have been described above, the present invention is not restricted to the contents of these preferred embodiments and various modifications are possible within the scope of the present invention.

The upstream relief valve 37 and the downstream relief valve 44 are not limited to the mechanical relief valves using a biasing force of a coil spring as described above, and solenoid valves that are controlled to open/close by the ECU 31 may be used. However, when the upstream relief valve 37 and the downstream relief valve 44 are solenoid valves, they are controlled so as to open in response to a stopping operation of the outboard motor 1.

The pressurization pump 45 may be omitted, and in that case, the fuel pump 39 defines and functions as a high pressure fuel pump.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an internal combustion engine;

an upstream fuel supply path to be connected to a fuel tank that stores a fuel of the internal combustion engine;

a vapor separator tank that is connected to the upstream fuel supply path, and separates a fuel vapor from a liquid fuel;

a downstream fuel supply path connected to the vapor separator tank;

a fuel pump that is provided inside the vapor separator tank, and discharges a fuel in the vapor separator tank into the downstream fuel supply path;

a fuel pressure sensor that detects a fuel pressure inside the downstream fuel supply path;

a controller that applies fuel pressure feedback control to the fuel pump according to detection results of the fuel pressure sensor;

a fuel injector that injects a fuel inside the downstream fuel supply path into the internal combustion engine;

a downstream check valve that is provided in the downstream fuel supply path, and allows a flow of fuel from the vapor separator tank to the fuel injector, and prohibits a flow of fuel from the fuel injector to the vapor separator tank;

a downstream bypass path including a first end connected to a downstream portion that is closer to the fuel injector than is the downstream check valve in the downstream fuel supply path, and a second end connected to an upstream portion between the downstream check valve and the vapor separator tank in the downstream fuel supply path; and a downstream relief valve that is provided in the downstream bypass path, and opens the downstream bypass path when a fuel pressure in a downstream region that is closer to the fuel injector than is the downstream check valve in the downstream fuel supply path exceeds a first predetermined value.

2. The outboard motor according to claim 1, wherein the fuel pressure sensor is located in the downstream region; and the downstream portion is positioned closer to the downstream check valve than is the fuel pressure sensor in the downstream region.

3. The outboard motor according to claim 1, wherein the fuel pump includes a first fuel pump including a check valve at a fuel discharge port connected to the downstream fuel supply path, and a second fuel pump not including a check valve at a fuel discharge port connected to the downstream fuel supply path.

4. The outboard motor according to claim 1, further comprising a pressurization pump that is located in the downstream region, and pressurizes and feeds a fuel in the downstream region into the fuel injector.

5. The outboard motor according to claim 4, wherein the downstream region includes a first fuel pipe connecting the downstream check valve and the pressurization pump, and a second fuel pipe connecting the pressurization pump and the fuel injector;

the fuel pressure sensor includes a first fuel pressure sensor that detects a fuel pressure inside the first fuel pipe, and a second fuel pressure sensor that detects a fuel pressure inside the second fuel pipe; and the controller applies fuel pressure feedback control to the fuel pump according to detection results of the first fuel pressure sensor, and applies fuel pressure feedback control to the pressurization pump according to detection results of the second fuel pressure sensor.

6. The outboard motor according to claim 5, wherein the first fuel pipe is elastically deformable, and the second fuel pipe is made of metal.

7. The outboard motor according to claim 1, further comprising:

an upstream check valve that is provided in the upstream fuel supply path, and allows a flow of fuel to the vapor separator tank, and prohibits a reverse flow of fuel from the vapor separator tank;

an upstream bypass path including a first end connected to a downstream portion that is closer to the vapor separator tank than is the upstream check valve, and a second end connected to an upstream portion farther away from the vapor separator tank than is the upstream check valve in the upstream fuel supply path; and an upstream relief valve that is provided in the upstream bypass path, and opens the upstream bypass path when a fuel pressure in an intermediate region between the upstream check valve and the vapor separator tank in the upstream fuel supply path exceeds a second predetermined value.

* * * * *